US007284964B2

(12) United States Patent
McDowell et al.

(10) Patent No.: US 7,284,964 B2
(45) **Date of Patent: *Oct. 23, 2007**

(54) PERISTALTIC INJECTOR PUMP LEAK MONITOR

(75) Inventors: William M. McDowell, Garden Grove, CA (US); John T. Nguyen, San Dimas, CA (US)

(73) Assignee: Blue-White Industries, Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/358,277

(22) Filed: Feb. 21, 2006

(65) Prior Publication Data

US 2006/0140779 A1 Jun. 29, 2006

Related U.S. Application Data

(63) Continuation of application No. 10/610,364, filed on Jun. 30, 2003, now Pat. No. 7,001,153.

(51) Int. Cl.
*F04B 53/04* (2006.01)
*F04B 43/12* (2006.01)

(52) U.S. Cl. ..... 417/63; 417/477.1

(58) Field of Classification Search ..... 417/63, 417/477.1; 92/5 R, 86; 60/455
See application file for complete search history.

(56) References Cited

U.S. PATENT DOCUMENTS

| | | | |
|---|---|---|---|
| 4,110,739 | A | 8/1978 | Kidd |
| 4,205,237 | A | 5/1980 | Miller |
| 4,443,333 | A | 4/1984 | Mahurkar |
| 4,576,553 | A | 3/1986 | Winston et al. |
| 4,661,045 | A | 4/1987 | Winston et al. |
| 4,679,432 | A | 7/1987 | Draeger |
| 5,062,770 | A | 11/1991 | Story et al. |
| 5,066,200 | A | 11/1991 | Ooka |
| 5,173,019 | A | 12/1992 | Sdano |
| 5,188,143 | A | 2/1993 | Krebs |
| 6,406,267 | B1 | 6/2002 | Mondiere |
| 6,458,109 | B1 | 10/2002 | Henley et al. |
| 6,623,612 | B2 | 9/2003 | Shirai |
| 2004/0105758 | A1 | 6/2004 | Ross |

FOREIGN PATENT DOCUMENTS

| | | |
|---|---|---|
| EP | 0403 296 B1 | 3/1995 |
| EP | 0 787849 A1 | 8/1997 |
| JP | 147-179 | 6/1989 |

*Primary Examiner*—Michael Koczo, Jr.
(74) *Attorney, Agent, or Firm*—Knobbe Martens Olson & Bear LLP

(57) ABSTRACT

A pump leak monitor for use with a peristaltic pump comprises a pump housing and a pair of electrical contacts disposed along a bottom end of the pump housing. The electrical contacts are located such that the contacts are immersed in fluid when the pump is leaking. The fluid conducts electricity across the contacts and thereby closes an electrical circuit for providing an indication that a leak has been detected. By measuring an electrical parameter in the circuit, the pump leak monitor is capable of measuring the conductivity of the fluid in the pump housing. As a result, the pump leak monitor is capable of differentiating between different types of fluid.

21 Claims, 7 Drawing Sheets

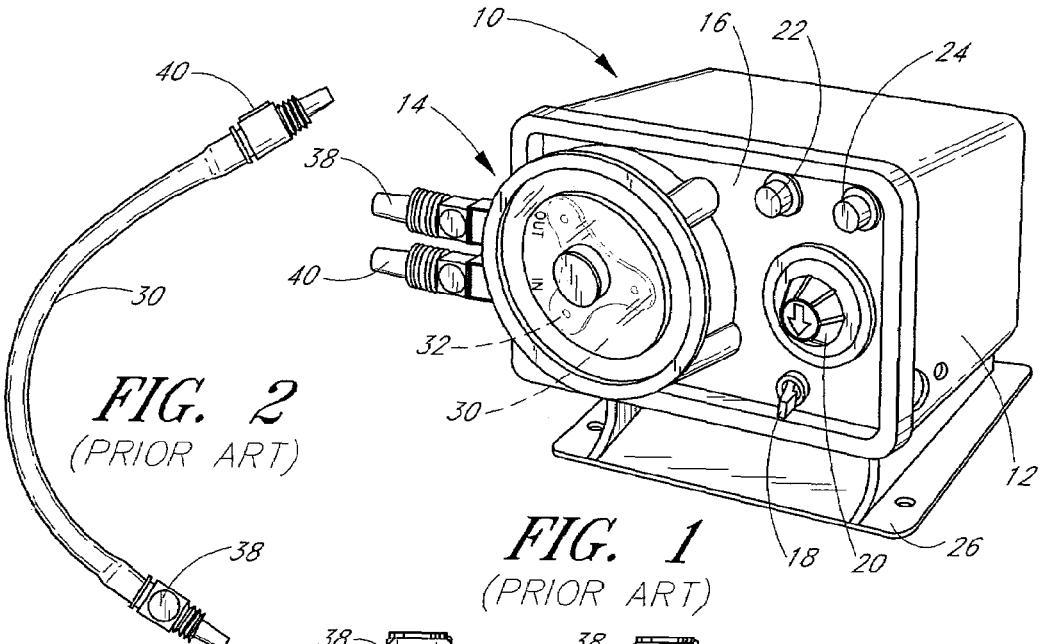
FIG. 2
(PRIOR ART)
FIG. 1
(PRIOR ART)
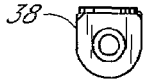
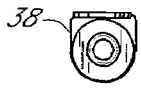
FIG. 3
(PRIOR ART)
FIG. 4
(PRIOR ART)
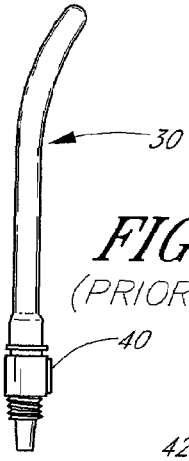
FIG. 5
(PRIOR ART)
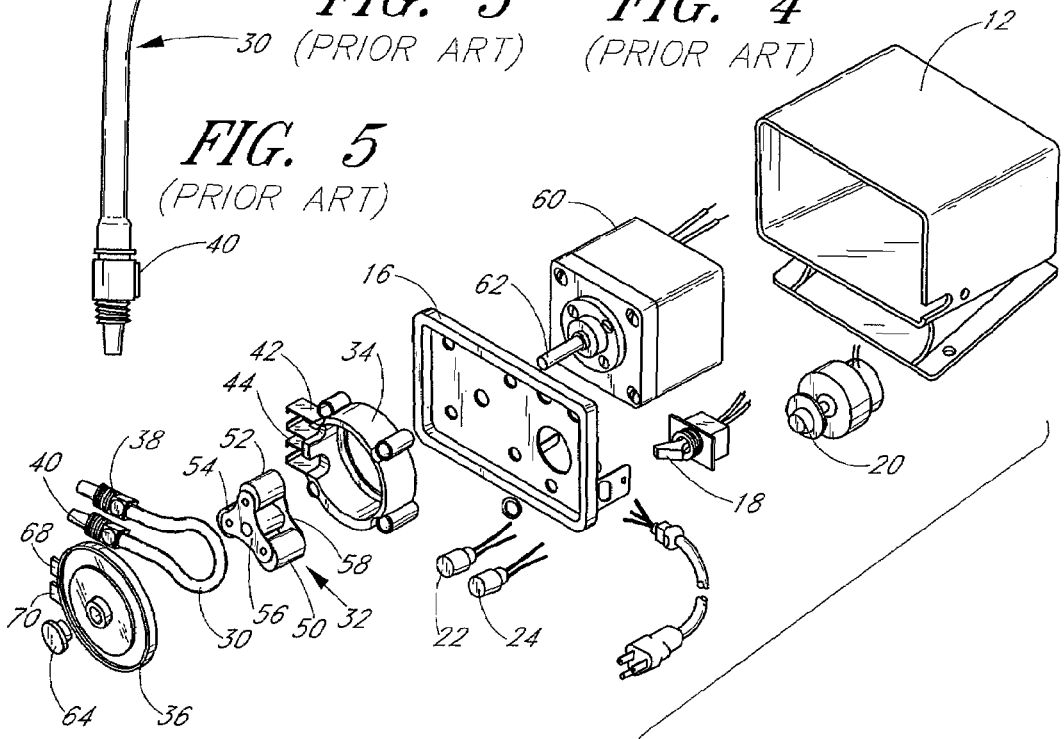
FIG. 6
(PRIOR ART)

PERISTALTIC INJECTOR PUMP LEAK MONITOR

RELATED APPLICATION

This application is a continuation of U.S. application Ser. No. 10/610,364, filed Jun. 30, 2003 now U.S. Pat. No. 7,001,153, the entirety of which is hereby incorporated herein by reference.

BACKGROUND OF THE INVENTION

1. Field of the Invention

This invention relates to pumps and more particularly to a pump leak monitor for use with a peristaltic pump.

2. Description of the Related Art

Peristaltic pumps have been devised to provide a steady flow of fluid through a conduit by pinching or squeezing the conduit along its length. Various types of peristaltic pumps are used in a wide variety of applications.

In one common form, a peristaltic pump includes a flexible tube that is housed in a circular, usually cylindrical, cavity. The tube is bent such that it extends along the curved inner wall of the cavity and forms a partial loop, hairpin or horseshoe shape. A rotating cam is provided at the center of the cavity for controlling the pump. The cam typically comprises three rollers, spaced 120 degrees apart, that are mounted on a motor-driven rotating carrier. As the rollers move in a circular path, the rollers compress the tube against the inner wall, thereby pinching the tube and pushing the fluid through the tube ahead of the rollers. Accordingly, the peristaltic pump essentially operates as a positive displacement pump wherein each roller pumps the entire volume of the fluid contained in the segment of the tube segment between it and the next roller.

Although peristaltic pumps have gained widespread popularity, the effectiveness of peristaltic pumps is severely limited by the design life of the tube. Due to the compression and relaxation produced by each pass of a roller, the tube in a peristaltic pump is subjected to continual cycles of stresses and strains. Furthermore, the movement of the rollers over the tube creates friction that can abrade the surface of the tube. Over time, the cycles of stretching, compression and abrasion will inevitably cause the tube to rupture. Alternatively, if a line downstream of the pump becomes constricted or occluded, the pressure within the tube can build up to the point wherein a "blowout" occurs. In either case, it is typically very difficult or impossible to predict when the tube will rupture.

Furthermore, in many pump applications, there is no immediate indication that the tube has ruptured within the peristaltic pump. This problem is compounded by the fact that many peristaltic pumps are configured such that it is difficult or impossible to see the condition of the tube during operation. In addition, the peristaltic pump may be located on a rooftop or other remote location. As a result, a ruptured tube may go unnoticed for an extended period of time.

If a tube cracks or ruptures during operation of the pump, fluid will leak from the tube into the pump cavity. As the leaking fluid comes into contact with the pump components, the pump may become irreparably damaged. When the pump is used to move a corrosive chemical, such as chlorine, leakage of the fluid into internal components is particularly harmful. Furthermore, if the problem goes unnoticed, the pump will continue to operate at a reduced level of functionality or may cease to function altogether over an extended period. When the pump is used for a critical function, such as, for example, the treatment of drinking water, biocide feed, or as part of an extracorporeal life support system, the reduced functionality of the pump may have particularly harmful consequences.

In an effort to address this problem, a variety of schemes have been proposed over the years for detecting leaks in peristaltic pumps and other similar devices. However, none of the proposed schemes has met with great commercial success. One reason for the lack of success is the inability of the leakage detection schemes to differentiate between different types of fluids. Many of the existing leakage detection schemes are triggered by the presence of any type of fluid and therefore may provide a false indication of a leak when the pump merely contains condensation, rain water or the like. When a pump contains a relatively innocuous fluid, such as water, and the pump is functioning adequately, it may not be desirable to provide an indication of a leak. Furthermore, when a leak is falsely indicated, much time and effort can be wasted looking for or replacing a broken tube when in fact none exists.

Accordingly, a need exists for an improved pump leak monitor that can quickly and reliably detect the presence of a fluid in a pump cavity. It is desirable that such a pump leak monitor has the capability to differentiate between different types of fluid in the pump cavity. It is also desirable that such a pump leak monitor be capable of use with a peristaltic pump to detect when a harmful fluid has leaked into the pump cavity. It is also desirable that such a pump leak monitor be capable of interconnection to a network for providing a remote indication of pump status. It is also desirable that such a pump leak monitor be quick and reliable and adaptable for use with existing technology.

SUMMARY OF THE INVENTION

Various embodiments of the present invention advantageously satisfy the need in the prior art by providing a pump leak monitor having the capability to detect the presence of a fluid and to differentiate between different types of fluids.

In one embodiment, a peristaltic pump having a pump leak monitor comprises a pump housing defining an interior volume having a bottom end portion adapted for capturing and containing a fluid. The interior volume encloses a flexible tube and a plurality of rollers for pushing a fluid through the tube. A pair of electrical contacts is provided at the bottom end portion of the pump housing. The contacts are located in a position wherein they become immersed when fluid is contained in the pump housing. A measurement device is electrically coupled to the pair of electrical contacts and provides the capability to measure a conductivity of the fluid for determining the fluid type.

In another embodiment, the pair of electrical contacts comprises a pair of pins disposed along a surface of said pump housing and extending inward into the interior volume. The pins may be made of a corrosion resistant material, such as a nickel alloy.

In another embodiment, the pump leak monitor is adapted to measure the conductivity of the fluid by monitoring the voltage differential or current flow across said pair of electrical contacts.

In another embodiment, the pump leak monitor includes a switch for deactivating the pump.

In another embodiment, the pump leak monitor is connected to network for providing a remote indication of pump status. The remote indication may include a remote terminal or a display for providing information on the type and/or amount of fluid in the pump housing.

In another embodiment, the pump leak monitor includes a valve or pump for automatically discharging fluid from the pump housing. The pump leak monitor may be configured such that only certain types of fluid are automatically discharged.

BRIEF DESCRIPTION OF THE DRAWINGS

FIG. 1 is an isometric view of an exemplary peristaltic pump as is known in the art.

FIG. 2 is a top plan view of a pump tube adapted for use with the pump of FIG. 1 and shown in relaxed condition.

FIGS. 3 and 4 are elevational views of the outlet of one of the end fittings of the tube in FIG. 2 shown from the inlet end and outlet end of the fitting, respectively.

FIG. 5 is a side view of the tube of FIG. 2 shown as it appears when pre-stressed and installed in the pump of FIG. 1.

FIG. 6 is an exploded view of the elements that form the pump of FIG. 1.

DETAILED DESCRIPTION OF THE PREFERRED EMBODIMENTS

Figure 7:
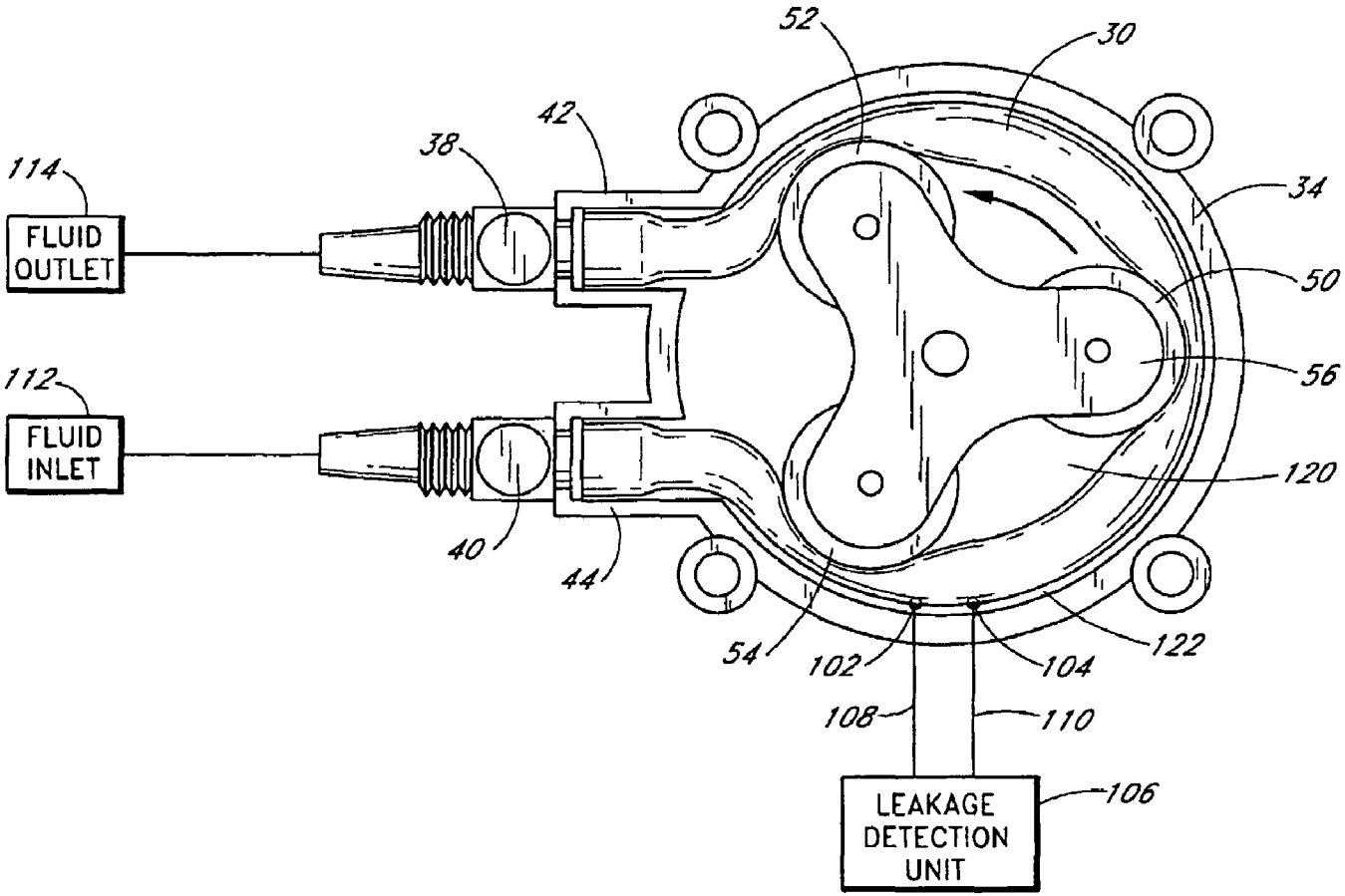
FIG. 7 is a schematic of a peristaltic pump incorporating a pump leak monitor according to one embodiment of the present invention.

Various embodiments of the present invention depict peristaltic pumps provided with a pump leak monitor for determining when a tube has ruptured within the pump. The disclosed embodiments of a pump leak monitor are primarily depicted and discussed in the context of being used in conjunction with a peristaltic pump and, as discussed below, aspects of the invention are particularly advantageous when used in conjunction with a peristaltic pump. On the other hand, it should be appreciated that the principles and aspects of these embodiments are applicable to other devices having structures and functionalities not discussed herein. Thus, the embodiments are not only applicable to peristaltic pumps, but may also be applicable to any system wherein it is useful to detect the presence of a fluid and to differentiate between different types of fluid. The manner of adapting the embodiments described herein to these various structures and functionalities will become apparent to those of skill in the art in view of the description that follows.

I. Overview of a Peristaltic Pump System

FIG. 1 illustrates an exemplifying embodiment of a peristaltic pump that may be used in conjunction with the pump leak monitor described below. The peristaltic pump may be used for a wide variety of applications, such as, for example, water treatment, blood circulation, food processing and dispensing, slurry feeding, photo-chemical processing or polymer injection. The model shown is driven by an electric motor at a selectable rotor speed, such as, for example, 15, 30 or 45 RPM. The pump can be used with a variety of different tube diameters, thereby providing a wide range of pumping rates with a given pump head and rotor size. Further, the pump construction permits periodic pausing or intermittent operation without loss of accuracy in average pumping rate.

As shown in FIG. 1, a peristaltic pump 10 generally includes a main housing 12, a pump 14 mounted along a panel 16 of the main housing, a power switch 18, an intermittent operation control knob 20, running lamps 22 and 24, and a mounting plate 26. The pump 14 includes a pump tube 30, a cam assembly 32, and a pump housing. The construction of these parts is described in more detail with reference to the exploded view shown in FIG. 6.

Referring now to FIG. 6, the pump housing includes a pump head 34, a rear cover or pump panel 16, and a front cover 36. When assembled the pump housing defines a generally cylindrical pump cavity that houses the pump tube 30 and cam assembly 32. As illustrated, the pump head 34 is formed with an arcuate or circular inner surface. The pump tube 30 extends along the inner surface of the pump head 34 in a substantially horseshoe shaped configuration. End fittings 38 and 40 are provided at the ends of the pump tube 30 for coupling to the tube end retainer legs 42 and 44 of the pump head. In the illustrated embodiment, the cam assembly 32 is provided with three roller cams 50, 52 and 54. The roller cams are mounted 120 degrees apart for rotation relative to the cam holder. The cam assembly 32 includes front and rear plates 56 and 58, sometimes referred to as spiders, and a spacer that interconnects the plates. The front and rear plates 56 and 58 are rotatably coupled to each of the roller cams 50, 52 and 54.

When assembled, the pole driver motor 60 and the pump head 34 are bolted to opposite sides of the panel 16. The panel serves as the rear cover of the pump housing and a motor shaft 62 extends into the cylindrical recess formed by the combination of the pump head 34 and panel 16. The cam assembly 32 is mounted on the motor shaft 62. The shaft preferably extends entirely through the spacer and the two plates 56 and 58, and the cam assembly 32 fits entirely within the cylindrical recess of the pump head 34 and panel 16. The motor shaft 62 is sufficiently long to extend through the transparent front cover 36 and into a fastener 64 that serves to hold the front cover in place.

The pump tube 30 is installed so that end fitting 38 is lodged in the U-shaped recess or channel that is defined by retainer leg 42. End fitting 40 is lodged in the U-shaped recess or channel defined by retainer leg 44. The intermediate section of tube 30 lies within the cylindrical pump cavity and extends along the inner surface of the pump head 34. It is positioned over and around the cam assembly and lies between the rear cover or panel 16 and the front cover 64, as best shown in FIG. 1.

The inner wall of the pump head 34 is substantially circular and its axis is coincident with the axis of motor shaft 62 and cam assembly rotation. In the illustrated embodiment, the clearance between each of the cam rollers 50, 52 and 54 and the inner wall is preferably about 2.6 mm. The clearance is selected such that the inner and outer walls of the tube are pinched together by the rollers to prevent communication between the portions of the tube lumen on either side of each roller. The tube is made of a resilient material and has an internal bias that causes it to expand to a substantially circular form in cross-section when in a relaxed condition.

During operation, the cam assembly rotates counterclockwise as viewed from the front. Accordingly, fluid to be pumped enters the tube at fitting 40 and exits at fitting 38. After one of the rollers has passed over the tube adjacent to fitting 40 and proceeds around away from the fitting, the tube returns to a circular cross-section. In doing so, it draws or receives fluid from the inlet line at the fitting. Fluid continues to flow into the tube until it is pinched shut by the succeeding roller. Thereafter, the fluid in the portion of the tube between the two rollers is forced along the length of the tube as the rollers travel in a circular motion. Finally, the fluid is discharged at outlet fitting 38. Because the tube expands to a circular cross-section as the roller passes, the unit serves as a suction pump.

To help extend the tube design life, the tube may be pre-stressed to a degree that exceeds the stresses imposed as an incident to roller operations. Pre-stressing is accomplished by twisting the tube against its renitence and holding it in twisted state. If pre-stressing exceeds the operational stresses in substantial degree, the operational stresses should have less of an effect on the tube.

The preferred pump tube may be pre-stressed by twisting it about its longitudinal center line in the direction of its length with predictable results. It is preferred that the tube be manufactured so that it is curved, as depicted in FIG. 2. The curved tube has an inner radius that is a little less than its outside radius. The result is a reduced tendency to twist during use in the pump. However, the radius of the relaxed tube is greater in preferred form than the installed radius so that the inner wall is compressed in some degree when installed. In that circumstance, cam action first relieves the compression and then stretches the inner wall as pinching becomes complete. The result is a smaller deviation from relaxed or zero stress.

When the tube is bent to smaller radius, and to the horseshoe shape that it has when installed, and when it is twisted less than one-half turn in the direction of its length by rotating the ends in opposite directions, it bends out of a flat plane to a curved plane as shown in FIG. 5. Until the degree of twist exceeds one-half turn, the tube shape remains substantially symmetrical about the transverse midplane that extends between the tube ends. That symmetry is lost if the degree of twist exceeds one-half turn, and the advantage of pre-stressing is lost.

In this embodiment, the tube is installed such that the intermediate portion is bent toward the rear wall of the pump cavity. The tube end fittings may be fixed to the pump head toward its forward face. As best shown in FIG. 6, the retainer legs 42 and 44 are positioned to hold the end fittings adjacent to the forward edge of the pump head. As shown in FIG. 1, the end fittings 38 and 40 are held in place by the retainer tabs 68 and 70 of the front cover.

FIGS. 3 and 4 show the outlet end and the inlet end, respectively, of the end fittings 38 and 40. Three sides are flat and the fourth side is rounded. The rear surface of the channels in the retainer legs 42 and 44 is rounded. The sides are flat and parallel. The end fittings 38 and 40 will fit into the retainer leg channels, and they will be prevented from rotating. The fitting is the key and the channels provide the keyway.

In this embodiment, the end fittings 38 and 40 are arranged such that they are oriented at an angle of about seventy degrees from one another in the direction radial to the tube axis. That is best shown in FIG. 2 where the tube is shown in relaxed condition. At the time of insertion the fittings are rotated toward one another through that seventy degrees. When the fittings are inserted in the grooves of the retainer legs, the legs alone oppose the renitence of the twisted tube. The tabs 68 and 70 are not strained. No more than the fastener 64 is needed to keep the cover 36 in place.

The preferred amount of pre-biasing is from two to six degrees per centimeter of tubing length within the pump cavity. The upper limit, however, is one-half turn over the length of the tubing. The lower limit is one-tenth turn over that length.

Although these and other measures can be taken to extend the design life of a flexible tube in a peristaltic pump, the tube will eventually rupture due to the continual cycles of compression, tension and abrasion produced by the rollers. Unfortunately, in many situations, a cracked or ruptured tube will not be immediately apparent, particularly if the resulting leak is relatively small. As a result, leakage fluid may pool inside the pump cavity and damage or destroy critical pump components. Damage is particularly likely to occur when a corrosive fluid, such as chlorine or acid, leaks from the tube. When pump components are damaged, it is often necessary to replace the entire pump, which can be very expensive. In another drawback, the reduced functionality of the pump may go unnoticed for an extended period of time. This is particularly problematic when the pump is used in a critical application (e.g., water treatment).

II. Pump Leak Monitor

Various embodiments of a pump leak monitor will now be described with reference to FIGS. 7 through 12. The pump leak monitor provides a means for quickly and reliably detecting the presence of a fluid and has the capability to differentiate between fluid types. Various embodiments of the pump leak monitor may be used in conjunction with a peristaltic pump, such as the peristaltic pump described above with reference to FIGS. 1 through 6. However, while having particular advantages when used in connection with peristaltic pumps, it should be appreciated that the principles and aspects of these embodiments may be applicable to other pump mechanisms or other similar devices wherein fluid may accumulate.

Referring now to FIG. 7, for purposes of illustration, one embodiment of a pump leak monitor is shown in combination with the peristaltic pump described above with reference to FIGS. 1 through 6. The pump leak monitor generally comprises a first electrical contact 102, a second electrical contact 104, and a measurement device generally referred to herein as a leakage detection unit 106. As described in more detail below, the leakage detection unit 106 is electrically connected to the first and second electrical contacts 102, 104 via conductors 108 and 110, for detecting the presence of a fluid.

As described above, the peristaltic pump includes a cam assembly comprising a plurality of rollers 50, 52 and 54, and a tube 30, each of which is located within a pump housing, partially defined by a pump head 34. A first end fitting 40 of the tube 30 is connected to a fluid inlet 112 and a second end fitting 38 of the tube 30 is connected to a fluid outlet 114. As generally described above, the cam assembly is driven by a motor (not shown) to rotate the rollers in a circular motion and thereby push fluid through the tube 30 from the fluid inlet 112 to the fluid outlet 114. The pump head 34 includes a generally cylindrically shaped inner wall that partially defines an interior volume, generally referred to herein as a pump cavity 120. The pump cavity is adapted for housing the cam assembly and includes a bottom end portion 122 configured for capturing and containing fluids.

In a preferred embodiment, the electrical contacts 102 and 104 comprise a pair of elongate pins. The pins are preferably made of a conductive material that is also corrosion resistant, such as a nickel alloy. In one preferred embodiment, each of the pins extends outward from a rear cover into the pump cavity 120. The pins are arranged in a fixed spaced-apart relationship along the bottom end portion of the pump cavity 120. However, it will be appreciated that the contacts 102 and 104 may be integrated as a single unit. Furthermore, the contacts (or sensors) may take a wide variety of different forms and may be located anywhere along the bottom end portion of the pump cavity 120. In addition, it will be appreciated that the "bottom end portion" of the pump cavity may refer to any location along the pump cavity where fluid flows to under the force of gravity, depending upon the particular orientation of the pump during use.

Figure 8:
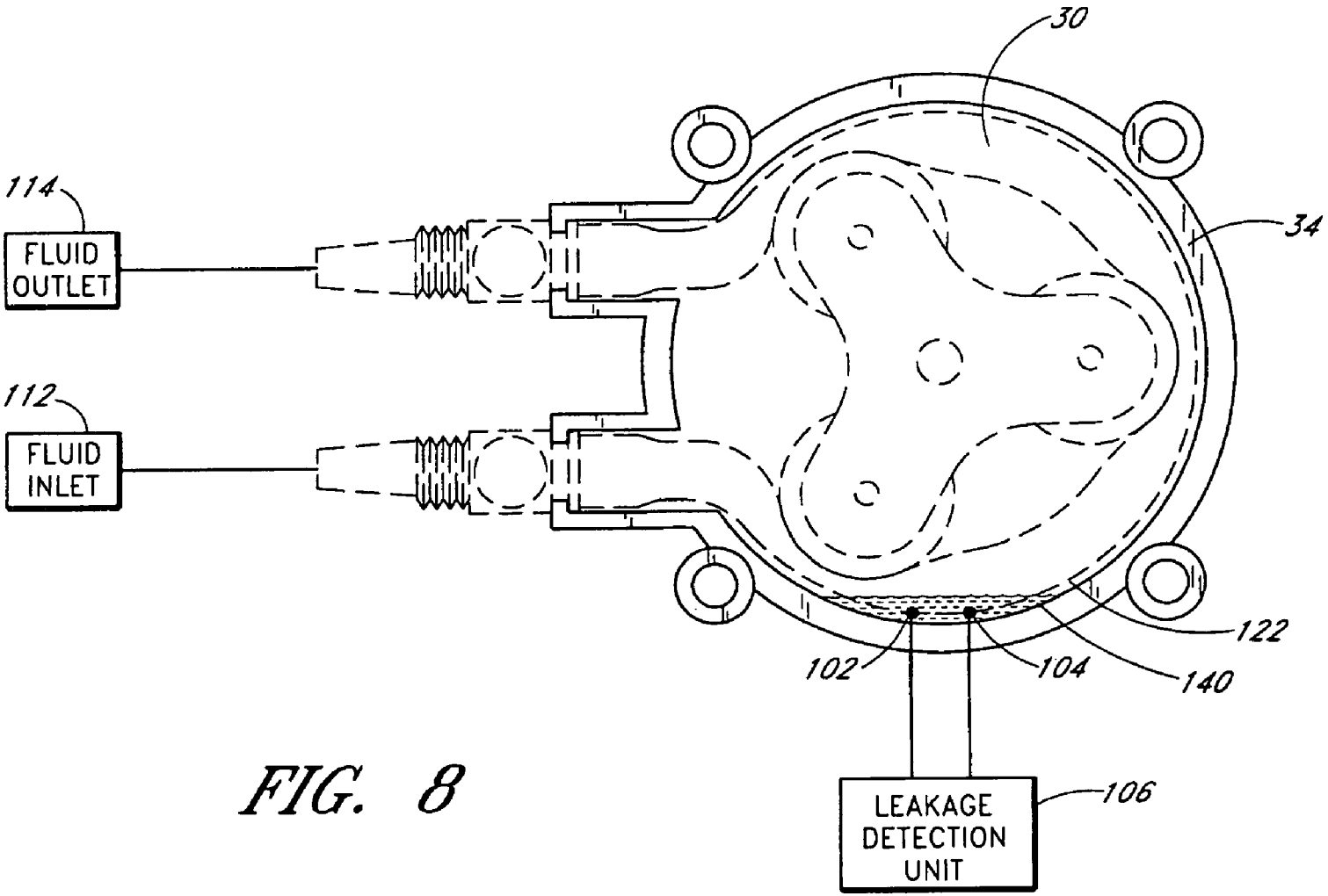
FIG. 8 is a side view of the embodiment shown in FIG. 7 wherein the electrical contacts are immersed in a fluid.

Referring now to FIG. 8, when the tube 30 cracks or ruptures, fluid 140 will leak from the tube and drip or otherwise flow downward within the pump cavity toward the bottom end portion 122. As illustrated, the first and second electrical contacts 102 and 104 are disposed along the bottom end portion 122 in a location wherein both contacts become immersed in the fluid 140.

Figure 9B:
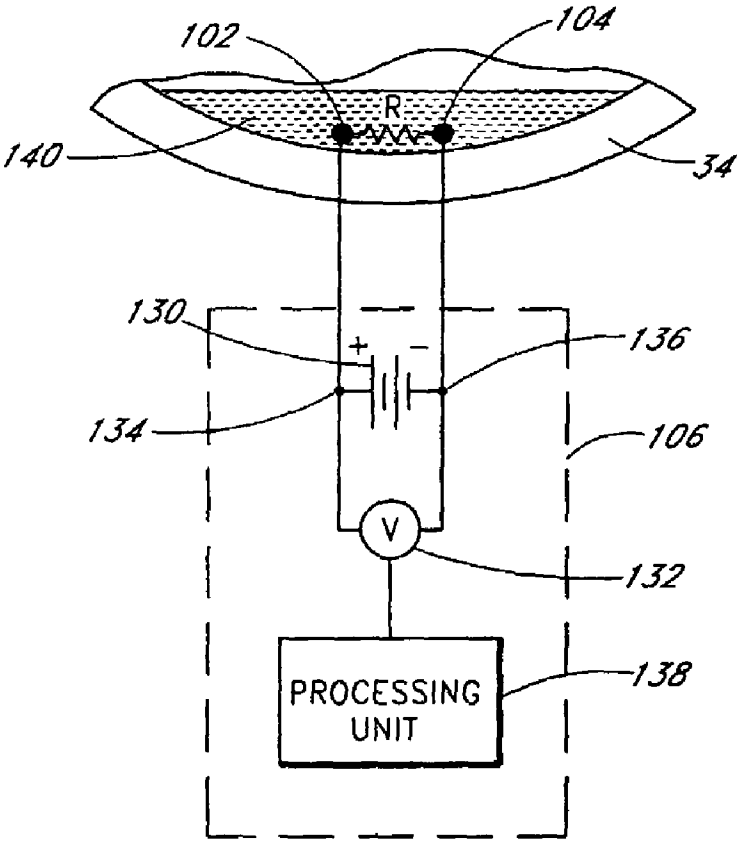
FIG. 9B is a schematic view illustrating the leakage detection unit shown in FIG. 9A when a fluid is present in the pump housing.
Figure 9A:
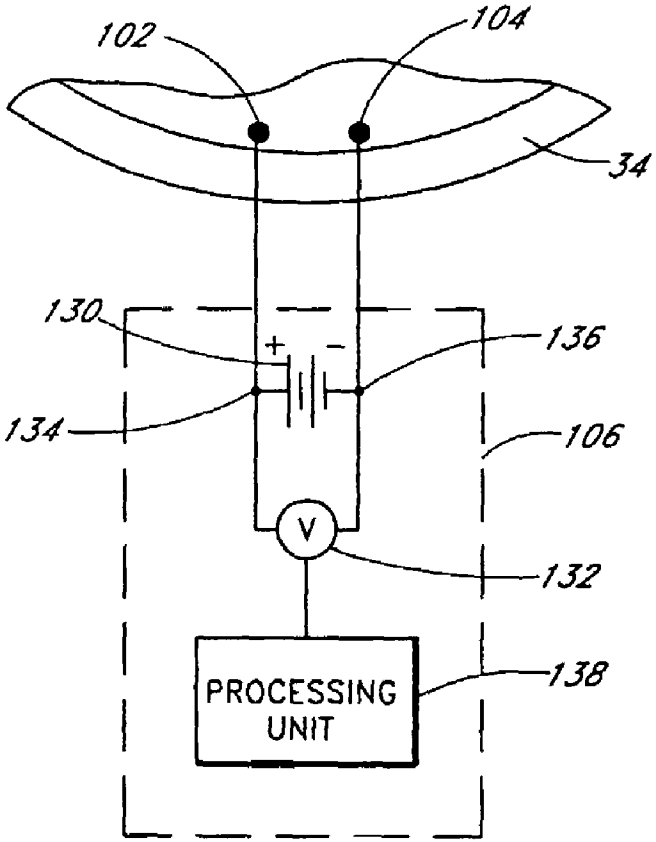
FIG. 9A is a schematic view illustrating one preferred embodiment of the leakage detection unit when no fluid is present in the pump housing.

Referring now to FIG. 9A, for purposes of illustration, one exemplifying embodiment of the leakage detection unit 106 comprises a voltage source 130 having a positive terminal 134 and a negative terminal 136, a voltmeter 132 and a processing unit 138. As shown, the first contact 102 is connected to the positive terminal 134 and the second contact 104 is connected to the negative terminal 136. In the illustrated embodiment, the voltmeter 132 is located for measuring the voltage differential across the contacts 102 and 104. The voltmeter 132 is electrically connected to the processing unit 138. As illustrated, when no conductive fluid is present, the electrical circuit of the leakage detection unit 106 is open. Accordingly, the voltage differential across the contacts 102 and 104 is approximately equal to the voltage across the voltage source 130. Based on an internal comparison with a known voltage, the processing unit 138 outputs a signal indicating that no fluid is present in the pump cavity.

Referring now to FIG. 9B, when a conductive fluid 140 is present along the bottom end portion of the pump cavity, the electrical contacts 102 and 104 become electrically coupled. The electrical coupling is schematically illustrated in FIG. 9B as a connection having a resistance R. Accordingly, an electrical current flows through the fluid 140 from the first electrical contact 102 to the second electrical contact 104. As a result of the electrical current, the voltage differential across the contacts is reduced. When a significant change in the voltage differential (or other electrical parameter) occurs, the processing unit 138 detects the presence of the fluid 140 in the pump cavity.

In a significant feature, the leakage detection unit 106 is further provided with the capability to distinguish between different types of fluids in the pump cavity. It is known in the art that different fluid types provide different levels of conductivity to the flow of electricity. Fluids with a large electrical resistance R have a low conductivity and vice versa. During operation, the particular conductivity of the fluid 140 in the pump cavity may be measured using the leakage detection unit 106. As discussed above, this measurement can be achieved in a wide variety of techniques, such as by measuring the voltage differential across the contacts. In a preferred embodiment, the leakage detection unit 106, or more particularly, the processing unit 138, includes data wherein known ranges of conductivity are assigned to various types of fluids within the processing unit 138. Therefore, by comparing the measured conductivity with the assigned ranges, the leakage detection unit is capable of determining the type of fluid that is present in the pump cavity. In one embodiment, the leakage detection unit 106 may be programmable, such that assigned ranges of conductivity may be added or deleted from a memory storage unit according to the particular function or fluid being pumped.

Although one embodiment of a leakage detection unit is illustrated in FIGS. 9A and 9B, it will be appreciated that any leakage detection circuitry may be used with the present invention wherein it is possible to measure the conductivity of the fluid. For example, the leakage detection unit may employ microprocessor-based circuitry to determine the conductivity. Furthermore, the circuitry may measure voltage, current, a combination of both or any other useful parameter.

Because the leakage detection unit 106 has the ability to distinguish between different types of fluid, the leakage detection unit may be advantageously configured to output a signal indicating a leak only when an actual problem (i.e., a ruptured tube) has occurred. When the processing unit 138 detects a conductivity level that is within the assigned range of the working fluid, the leakage detection unit outputs a signal indicating that the tube has ruptured. Accordingly, the leakage detection unit 106 can quickly and reliably detect the presence of a leak in the tube. As a result, the pump may be attended to immediately before the leaking chemical can damage or destroy vital pump components.

At the same time, because the leakage detection unit 106 has the ability to distinguish between different types of fluids, the leakage detection unit may be configured such that no leakage indication will be output when a relatively harmless fluid (e.g., rain water) is present in the internal cavity. This is a significant advantage over various existing schemes wherein no means are provided for eliminating false indications of a ruptured tube. By eliminating false indications, the pump leak monitor of the present invention saves time, money and resources by avoiding unnecessary maintenance.

Figure 10:
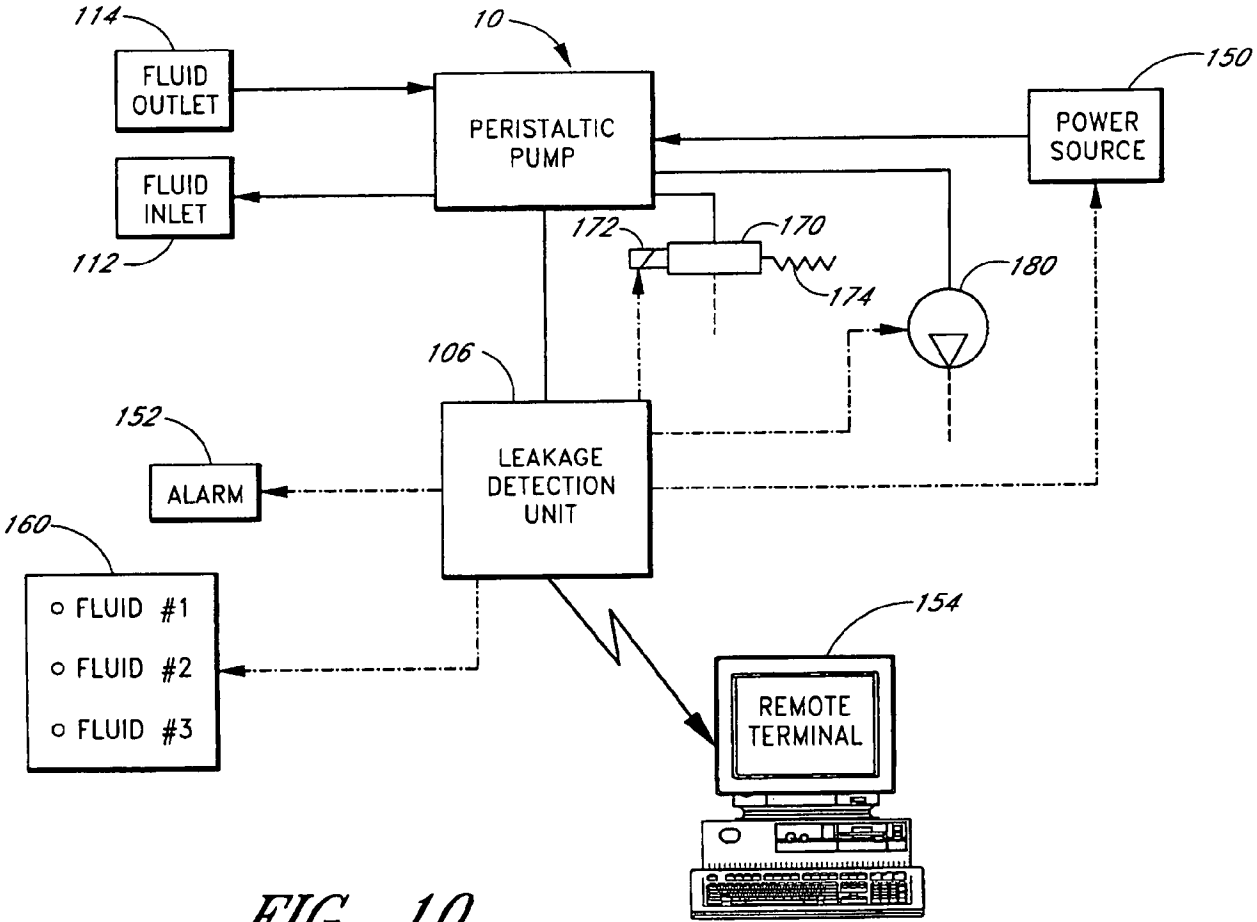
FIG. 10 is a schematic block diagram illustrating exemplifying connections of the leakage detection unit with various other components, such as a power source, a solenoid valve, a discharge pump, an alarm, a fluid-type indicator and a remote terminal.

Referring now to FIG. 10, the connection of the leakage detection unit 106 to various other components is schematically illustrated. Each of the illustrated components may be used alone or used in combination with other components. In one feature, the leakage detection unit 106 is electrically connected to a power source 150 for shutting off power to the pump when a problem is detected. In variations of this feature, the leakage detection unit 106 may output a signal to an on/off switch or directly to the motor. In any case, the leakage detection unit may be used to disengage or deactivate the motor in response to the detection of leakage fluid in the pump cavity. Therefore, in the event of a ruptured tube, the pump leak monitor may be used to automatically shut down the entire system rather than allowing the system to operate at a reduced functionality.

In another feature, the pump leak monitor may be configured such that the leakage detection unit 106 outputs a signal to an alarm 152, such as, for example, a bell or a buzzer, that visually or audibly indicates the detection of a leak. In still another feature, the pump leak monitor may be configured such that the leakage detection unit 106 is connected to a remote terminal 154, such as via a network, to provide a remote indication of the pump status. The pump status may be based on the measurement of conductivity in the pump cavity. In still another feature, the pump leak monitor may be configured to output a signal to a display 160 that identifies the particular type of fluid detected within the pump cavity. If desired, the fluid display 160 may be used in combination with the remote terminal 154.

In yet another feature, the pump leak monitor may be configured such that the leakage detection unit 106 is electrically connected to a valve 170 that is in fluid communication with the pump cavity. Accordingly, if fluid is detected in the pump cavity, the leakage detection unit 106 may send a signal to open the valve such that the fluid is allowed to drain from the pump cavity. The illustrated embodiment comprises a valve 170 operated by a solenoid 172 and includes a spring return 174. Alternatively, under certain conditions, it may be more desirable to electrically connect the leakage detection unit 106 to a pump 180 for discharging the fluid from the pump cavity. The valve 170, pump 180 and other similar embodiments may be particularly useful for automatically discharging condensation water or other fluids from the pump cavity. Because the pump leak monitor has the capability to differentiate between different fluids, it may be possible to configure the apparatus such that the discharging of fluid only occurs when certain fluid types are detected in the cavity.

Figure 11:
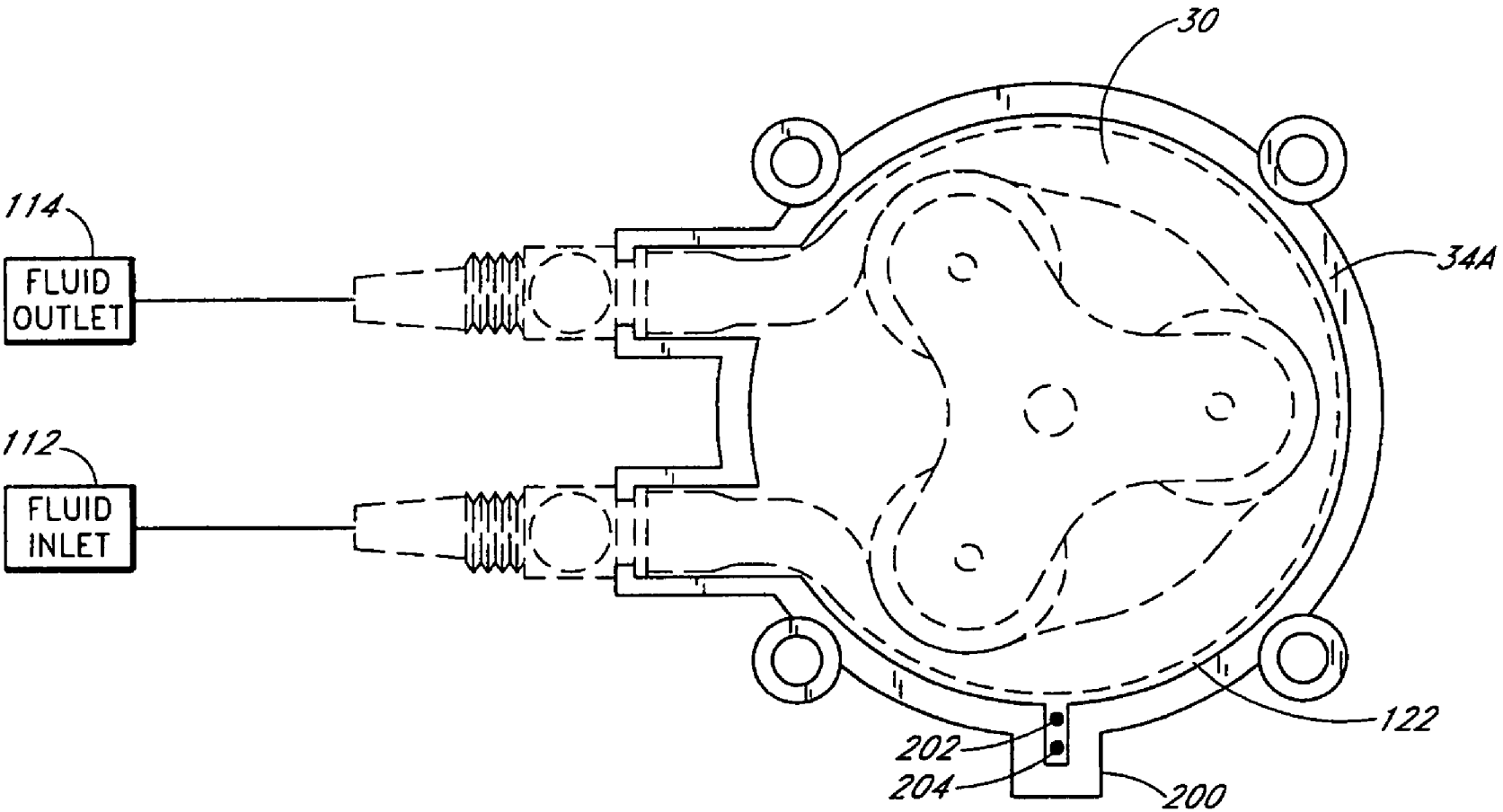
FIG. 11 is a side view of an alternative embodiment of a pump housing formed with a notch for collecting fluid.

FIG. 11 illustrates another alternative embodiment wherein the pump head 34A is formed with a notch 200 along the bottom end portion for capturing fluid. In this embodiment, the electrical contacts 202 and 204 are contained within the notch 200.

Figure 12:
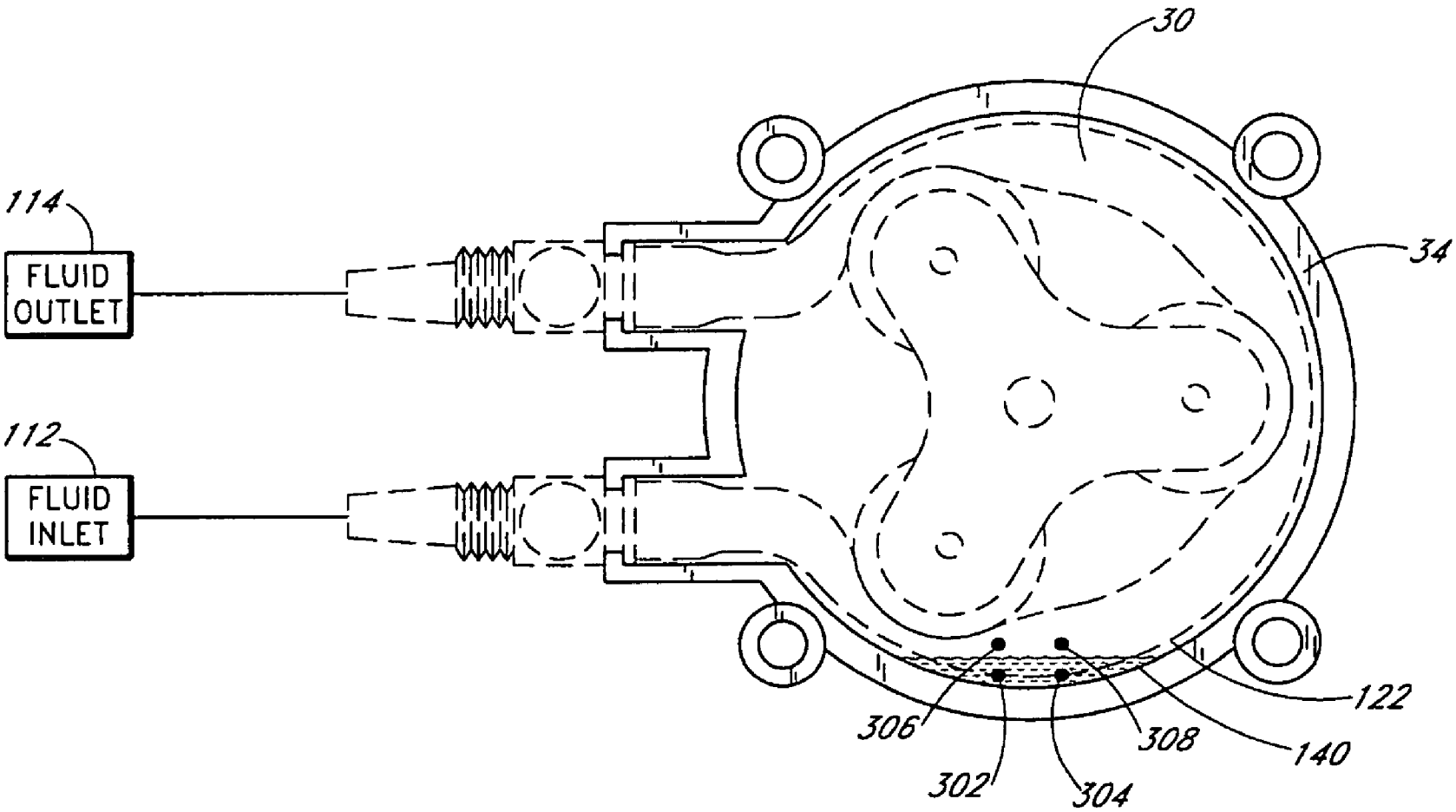
FIG. 12 is a side view of another alternative embodiment of a pump cavity provided with a plurality of electrical contacts for measuring the quantity of fluid in the cavity.

FIG. 12 illustrates yet another alternative embodiment wherein a plurality of electrical contacts 302, 304, 306 and 308 are provided along the bottom end portion of the pump head 34. This embodiment provides the pump leak monitor with the additional capability to measure the amount or level of fluid in the pump cavity. It may not be desirable to provide an indication of a leak when only a small amount of a fluid is present. However, at the same time, it may be useful to provide an indication that the fluid exists. By providing a plurality of pins at different heights, it is possible to estimate the amount of fluid in the pump cavity.

The above presents a description of the best mode contemplated for a pump leak monitor according to various preferred embodiments of the present invention. The above also describes the manner and process of making and using it, in such full, clear, concise, and exact terms as to enable any person skilled in the art to which it pertains to make and use this device. The embodiments of the pump leak monitor described herein are, however, susceptible to modifications and alternate constructions that are fully equivalent. Consequently, it is not the intention to limit this pump leak monitor to the particular embodiments disclosed.

What is claimed is:

1. A peristaltic pump having a pump leak monitor, comprising:

a pump housing defining an interior volume, said interior volume having a bottom end portion configured for capturing and containing a fluid;

a flexible tube disposed within said interior volume of said housing;

a plurality of rollers mounted on a rotatable carrier for carrying said rollers in a substantially circular path, said rollers being positioned for engagement with said tube;

a pair of electrical contacts positioned to be contacted by the fluid when the fluid leaks from said tube;

a measurement device electrically coupled to said pair of electrical contacts and adapted for measuring a conductivity of the fluid; and a processor for comparing the measured conductivity of the fluid with a stored range of conductivity.

2. The peristaltic pump of claim 1, wherein said pair of electrical contacts comprises a pair of pins disposed within a notch formed within said pump housing.

3. The peristaltic pump of claim 2, wherein said pins are made of a substantially corrosion resistant nickel alloy.

4. The peristaltic pump of claim 1, wherein said measurement device measures a voltage differential across said pair of electrical contacts.

5. The peristaltic pump of claim 1, wherein said measurement device measures an electrical current across said pair of electrical contacts.

6. The peristaltic pump of claim 1, further comprising a switch for automatically turning off said pump after a leak has been detected.

7. The peristaltic pump of claim 1, wherein said measurement device is connected to a remote terminal for providing a remote indication of pump status.

8. The peristaltic pump of claim 7, wherein said measurement device communicates to said remote terminal over a telephone line.

9. The peristaltic pump of claim 1, wherein the processor is configured to compare the measured conductivity with a plurality of stored conductivity ranges.

10. The peristaltic pump of claim 1, wherein the processor is programmable to add a conductivity to memory.

11. The peristaltic pump of claim 1, wherein said pair of electrical contacts are disposed within a notch, said notch being formed along a bottom end portion of said pump housing.

12. A pump having a pump leak monitor, comprising:

a pump housing defining an interior volume, said interior volume having a bottom end portion configured for capturing and containing a fluid;

a fluid pump;

a pair of electrical contacts positioned to be contacted by the fluid;

a measurement device electrically coupled to said pair of electrical contacts and adapted for measuring a conductivity of the fluid for determining the fluid type; and a processor for comparing the measured conductivity of the fluid with a stored conductivity.

13. The pump of claim 12, further comprising a switch for shutting off power to said pump when a certain fluid type is detected by said measurement device.

14. The pump of claim 12, wherein the stored conductivity is a plurality of stored conductivity ranges.

15. The pump of claim 12, further comprising a second pair of electrical contacts configured to measure a level of leaked fluid.

16. The pump of claim 12, wherein the processor is programmable to add a conductivity to memory.

17. The pump of claim 12, wherein said pair of electrical contacts are disposed within a notch, said notch being formed along a bottom end portion of said pump housing.

18. A peristaltic pump having a pump leak monitor, comprising:

a pump housing defining an interior volume, said interior volume having a bottom end portion configured for capturing and containing a fluid;

a flexible tube disposed within said interior volume of said housing;

a plurality of rollers mounted on a rotatable carrier for carrying said rollers in a substantially circular path, said rollers being positioned for engagement with said tube for pushing a working fluid through said tube;

a pair of pins positioned to be contacted by the fluid when the fluid leaks from said tube, said pins being made of a substantially corrosion resistant nickel alloy;

a measurement device electrically coupled to said pair of electrical pins and adapted to measure a voltage differential between said pins for determining a conductivity of the fluid;

a processor for comparing the measured conductivity of the fluid with a stored conductivity; and a remote terminal electrically connected to said measurement device for providing a remote indication of pump status.

19. The peristaltic pump of claim 18, wherein the stored conductivity is a plurality of stored conductivity ranges.

20. The peristaltic pump of claim 18, wherein the processor is programmable to add a conductivity to memory.

21. The peristaltic pump of claim 18, wherein said pair of electrical contacts are disposed within a notch, said notch being formed along a bottom end portion of said pump housing.

* * * * *